United States Patent [19]

Fabanich

[11] Patent Number: 4,913,429

[45] Date of Patent: Apr. 3, 1990

[54] BOWLING BALL

[76] Inventor: John P. Fabanich, 4301 Colorado Ave., Sheffield Village, Ohio 44054

[21] Appl. No.: 250,923

[22] Filed: Sep. 29, 1988

[51] Int. Cl.[4] ..... A63B 37/06; A63B 37/10

[52] U.S. Cl. ..... 273/63 E; 273/63 D

[58] Field of Search ..... 273/63 R, 63 C, 63 D, 273/63 E, 63 F, 63 G, 63 A, 63 B

[56] References Cited

U.S. PATENT DOCUMENTS

| | | | |
|---|---|---|---|
| 531,103 | 12/1894 | Dokkenwadel | 273/63 R |
| 2,291,738 | 8/1942 | Luth et al. | 273/63 E |
| 3,265,392 | 8/1966 | Degner et al. | 273/63 R |
| 3,386,176 | 6/1968 | Lotta | 273/63 R |
| 3,400,929 | 9/1968 | Fabanich | 273/63 E |
| 4,121,828 | 10/1978 | Amburgey | 273/63 E |
| 4,121,829 | 10/1982 | Amburgey | 273/63 E |
| 4,320,899 | 3/1982 | Salvino | 273/63 E |

*Primary Examiner*—George J. Marlo
*Attorney, Agent, or Firm*—Gustalo Nunez

[57] ABSTRACT

A bowling bowl having a solid core surrounded by a solid spherical shell. The solid core, which is substantially spherical in configuration, further includes a top weight which is generally conical in configuration and two extending side wings which are generally alike in configuration but placed at different angles with respect to each other. The two side wings which extend outwardly from the solid core have a generally flat surface on one side of the extending wing. The described flat surfaces of each extending wing describe a plane generally perpendicular to each other. The combination of the top weight and two extending side wings give the bowling ball more even and constant revolutions at the time contact with the pins is made. Also, the combination keeps the high rolling track of a high roller off of the thumb and finger holes. Further, the combination also gives the ball an exceptionally positive trajectory, a very thorough impact, less deflection upon impact and a methodical penetration at impact.

8 Claims, 3 Drawing Sheets

BOWLING BALL

FIELD OF THE INVENTION

This invention relates to bowling balls having a weighted insert for giving the ball more direction, trajectory and more revolutions at point of impact.

DISCUSSION OF THE PRIOR ART

Bowling is a sport that has been with us for hundreds of years and which is even chronicalized in the tale of Rip Van Winkle. Bowling is a sport in which the number of persons participating in continually increasing as evidenced by the construction of bowling palaces. Generally speaking the bowling ball has a thumb hole and two fingers holes; however, this can vary depending upon the desires of the user. For example, the ball can be drilled with one thumb hole and one finger hole, or with one thumb hole and up to three finger holes. Throughout the years, bowling enthusiasts have been attempting to design bowling balls that have deep penetration upon impact with the pins, thereby increasing more pin action which results in higher scores. Also, bowling balls must meet certain size and weights requirements as dictated by the American Bowling Congress; i.e., the ball circumference between 26.704 inches and 27.002 inches, the ball diameter between 8.500 inches and 8.595 inches, and a weight of not more than 16 pounds. After drilling of the finger and thumb holes, the maximum weight of the ball should not be greater than a gross weight of 16 pounds, 3 oz. top weight, 1 oz. left to right or 1 oz. front to back. Most balls are manufactured such that the bowling ball is formed by a core material with a pancake type weight encased by a continuous outer shell which is generally spherical in configuration.

Throughout the history of the sport, bowlers have attempted to design a "dream" ball, i.e. one which can increase one's score dramatically. This can only be done with a ball that can be thrown accurately, that will stay on track while rolling, and one which has dramatic pin mixing characteristics.

For example, Amburgey, U.S. Pat. No. 4,121,828 provides a bowling ball in which a disk core is positioned within the ball and disposed normal to the rolling axis thereof. A top weight is arranged within the outer marginal edge of the disk core in underlying relationship with respect to the finger holes. The mass of the top weight is greater than the mass of the disk. With this configuration, according to Amburgey, the ball is stabilized such that the ball travels down the alley in an improved manner and, upon impact with the pins, is not deflected.

Salvino, U.S. Pat. No. 4,320,899 attempts to solve the problem of an unstable ball by the use of a pair of weight blocks which are provided internally in the ball to compensate for the weight list because of the drilling of the finger and thumb holes. The weight blocks are positioned so as to be intersected by the finger and thumb holes when drilled. This results in a ball that exhibits stability without wobble when rolling down the alley.

SUMMARY OF THE INVENTION

In accordance with the present invention, there is provided a bowling ball having a core member and an outer shell completely encasing the core. The configuration of the core is unique. The core is formed of a material having relatively high density, a material such as barium oxide. The core, although one complete integral member, may be analyzed as if having four components. The center core resembles a sphere having a frusto-conical member extending outwardly at the top of the sphere, and two semi-frusto-conical members extending outwardly at each side of the sphere, such that the longitudinal axis of the top frusto-conical member is generally normal to the longitudinal axis described by the two semi-frusto-conical extending members. The mass of the extending members need not be equal, this is determined by what kind of ball the user desires. The thumb hole and finger holes are drilled such that the top frusto-conical member is normally located between the thumb hole and finger holes, depending on the drilling of the ball.

The top conical member provides a top weight to the ball and will rotate in a plane which is parallel to the plane defined by the track of the ball. The semi-frusto-conical member extending outwardly to the right, when viewing the ball from the thumb hole direction, provides for a right-handed bowler, when the ball is rolling, weight to the rolling axis which is designed to keep the track of a high roller off the thumb and finger holes. The semi-frusto-conical member extending outwardly right of the thumb hole provides an off center counter weight which accomplishes the above.

The top extending frusto-conical member is placed as close to the top of the outer shell as desired, depending on what type of ball is desired. For purposes of this application the top of the ball is defined as being located at the place where the top extending frusto-conical member is fixed.

The bowling ball to be specifically described in the detailed description is a ball which provides good revolution weight, good side axis weight and food center weight. These features give the ball an exceptionally positive trajectory, less deflection, methodical penetration and a ball which mixes the pins with maximum efficiency.

The uniqueness and the advantages of the present invention will become readily apparent to those skilled in the art reading the following detailed description and claims and by referring to the accompanying drawings.

DETAILED DESCRIPTION OF THE PREFERRED EMBODIMENT

Figure 1:
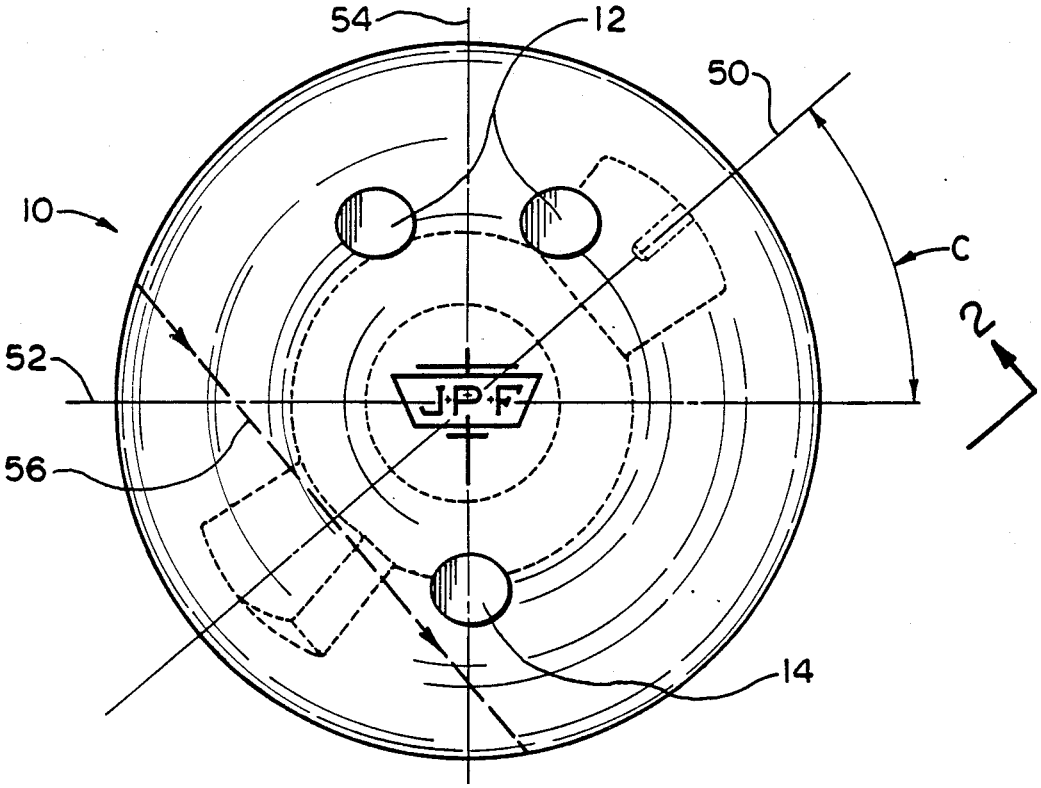
FIG. 1, represents a top view of a bowling ball with a blowing ball core insert shown in cross-sections.

In the figures shown in the drawings, like or similar numerals, wherever logical or practical to do so, will relate to like or similar elements.

In the embodiment shown in FIG. 1, there is a bowling ball 10 having a thumb hole 14 and two finger holes 12 on opposite sides of the indicia JPF. The bowling ball in order to meet the specifications of the American Bowling Congress must have a circumference between 26.704" and 27.002" and a diameter of between 8.500" to 8.595". Further, the ball cannot weigh more than 16 pounds. The hardness of the bowling ball shell should be a minimum of 72, on a Durometer scale. The composition of the material used to form the outer shell may be plastic, rubber, polyester or urethane or any non-magnetic material. The bowling ball outer shell, in and of itself, forms no part of the present invention and will not be described in any kind of detail. The ball contemplated in this invention is a two part ball, however, it can be fabricated as a three part ball or as a four part ball.

Figure 4:
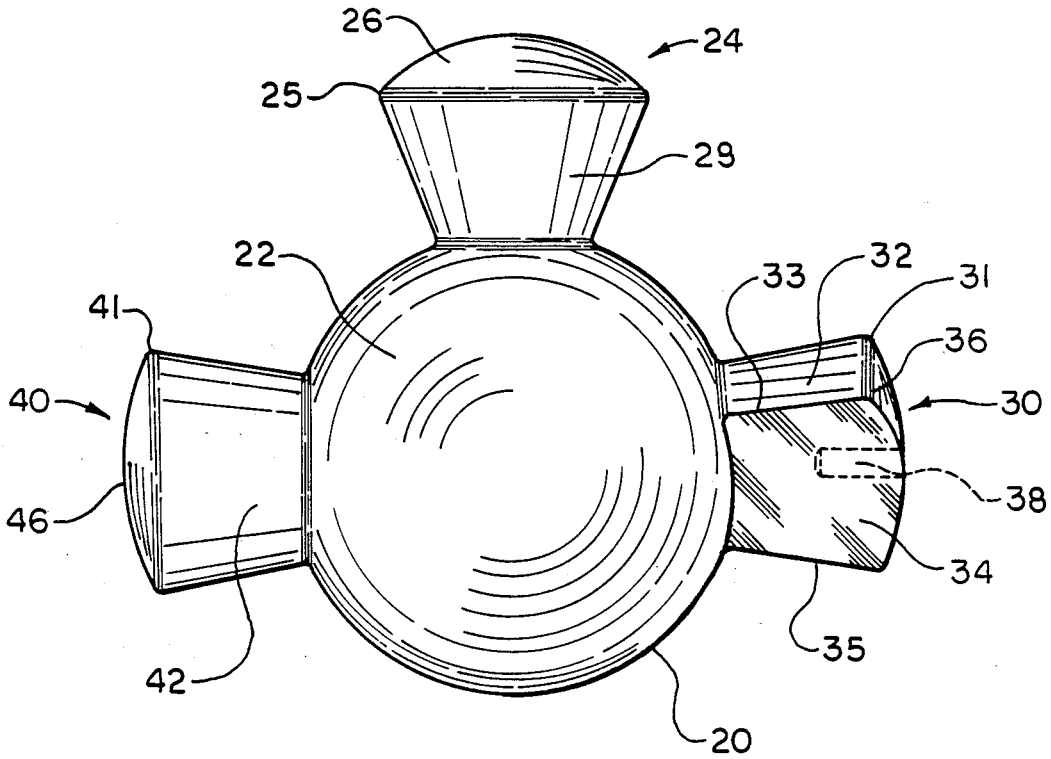
FIG. 4, represents a front view of the bowling ball core insert shown in FIG. 3, taken along line 4—4.

According to the present invention, located inside the bowling ball 10 is a core 20. The core includes a spherical member 22 and one top outwardly extending weight member 24, (as shown in FIG. 4). This top extending weight member 24 is frusto-conical in configuration, i.e., it resembles an outwardly extending cone, at one end thereof being integral to the sphere 22 and at the other end thereof, terminating at an edge 25. The frusto-conical member 24 terminating in the configuration generally resembling a segment of a sphere, or said in another way, being a convex surface 26. The frusto-conical member 24 being further defined by an outside wall surface 28. A frusto-conical configuration can also be described as an elongated cylinder having an one end, a diameter greater than the diameter at the other end, and one in which the diameter increases at a constant rate.

Figure 2:
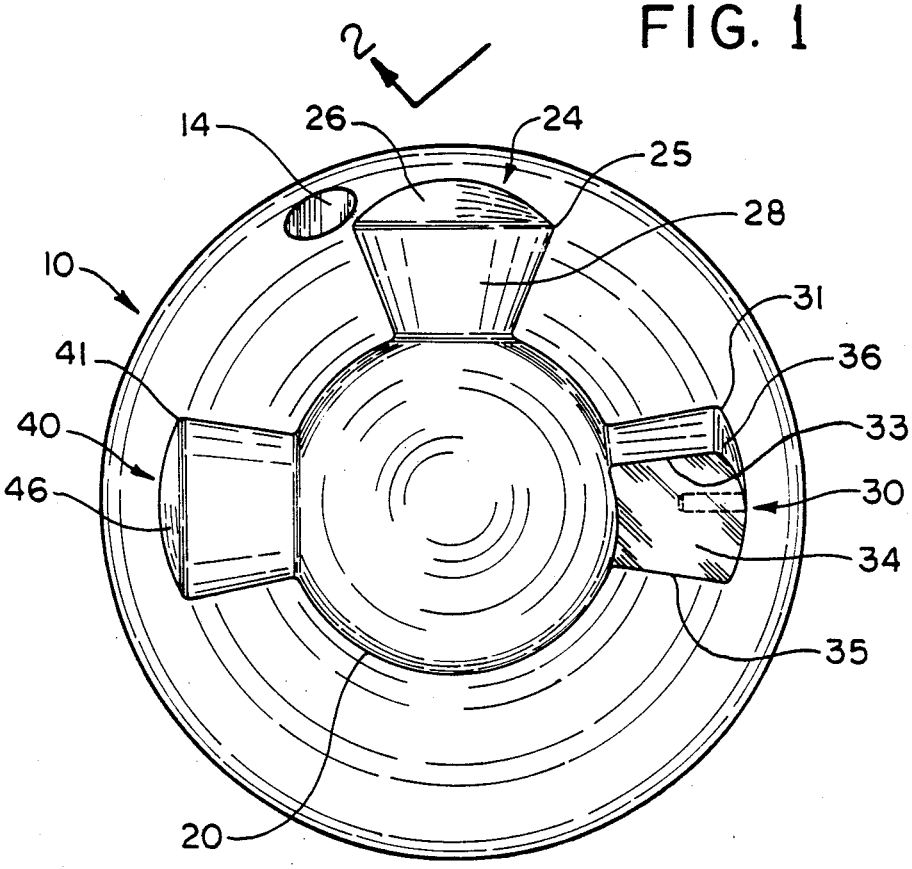
FIG. 2, represents a front view of a bowling ball with a bowling bail core insert shown in elevation.
Figure 3:
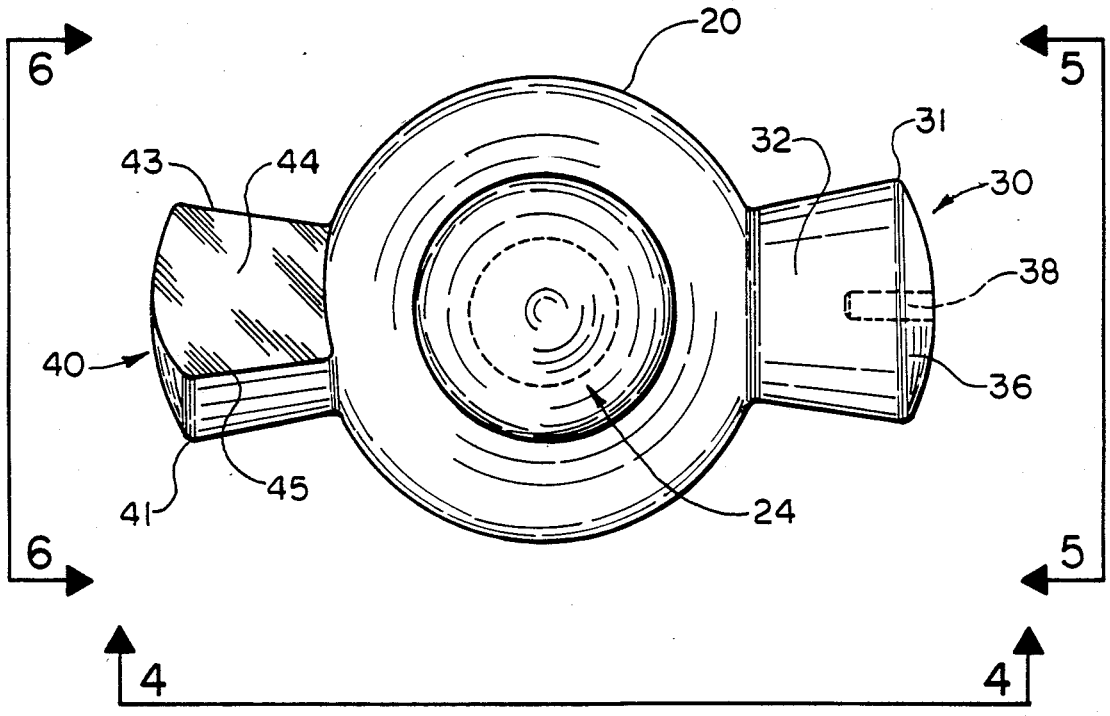
FIG. 3, represents a top view of the bowling ball core insert.

Again, using FIG. 4 as our reference figure, there is located on one side of the ball, which shall henceforth be referred to as the "positive" side, an outwardly extending wing member 30 which for purposes of explanation will also sometimes be referred to as the pin side member for reasons which will soon become evident. Said pin side member 30 appears in configuration to resemble an outwardly extending elongated frusto-conical member, (FIG. 3), excepting that the frusto-conical pin side member is cut along its longitudinal axis such that a flat surface 34 (FIG. 2) is defined throughout the length of the pin side member 30 and further defined by edges 33, 35, and 31. The pin side member 30, also which is integral to the sphere 20, is capped at the end away from sphere member 20, with a convex surface 36 which can also be described as the segment of a sphere. The pin side member 30 is further defined by an outside wall surface 32. Located on the convex surface 36 is a pin hole 38, which is used in the process of manufacturing the bowling ball 10.

Located on a side opposite pin side member 30 is an outwardly extending wing member 40, this side will be referred to as the negative side of the ball. Said wing member 40, like pin side member 30, appears to be an elongated frusto-conical member in configuration, excepting that like pin side member 30, wing member 40 is also cut along the longitudinal axis thereof such that there is defined a flat surface 44 throughout the length of wing member 40 and further defined by edges 41, 43, and 45. The wing member 40, also integral to the sphere 20, is capped at the end away from sphere member 20, with a convex surface 46. Wing member 40, is further defined by an outside wall surface 42. The extending wing members 24, 30, and 40, are all generally fixed in the same plane.

The pin 38 is used to hold the core 20 in the bowling ball mold such that the top extending member is closer to the outside shell 10 of the bowling ball 10 and hence, becomes known as a top weight. The core 20 is not centered in the bowling ball 10, it is set in the shell member 10 according to the top weight desired by the manufacturers. Looking at FIG. 1, it can be seen that the top extending member 24 is located at the intersection of lines 52 and 54. The outwardly extending wing members 30 and 40 are approximately equidistant from the outside shell cover of the bowling ball 10. Pin side member 30 is extending outwardly further than wing member 40, such that by reason of the larger size, pin side member 30, is heavier than wing member 40. The reason for this will be explained below. The finger holes 12 and thumb hole 14 are drilled such that the top extending element lies between the finger holes 12 and thumb hole 14. Other desired hole drillings can be made according to the satisfaction of the bowler.

Figure 5:
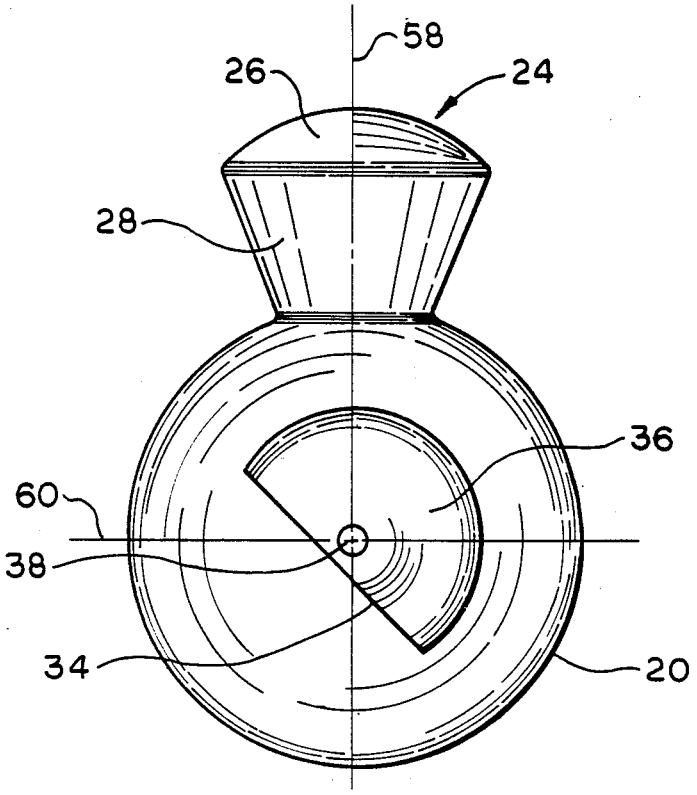
FIG. 5, represents a side view of the bowling ball core insert shown in FIG. 3, taken along line 5—5.
Figure 6:
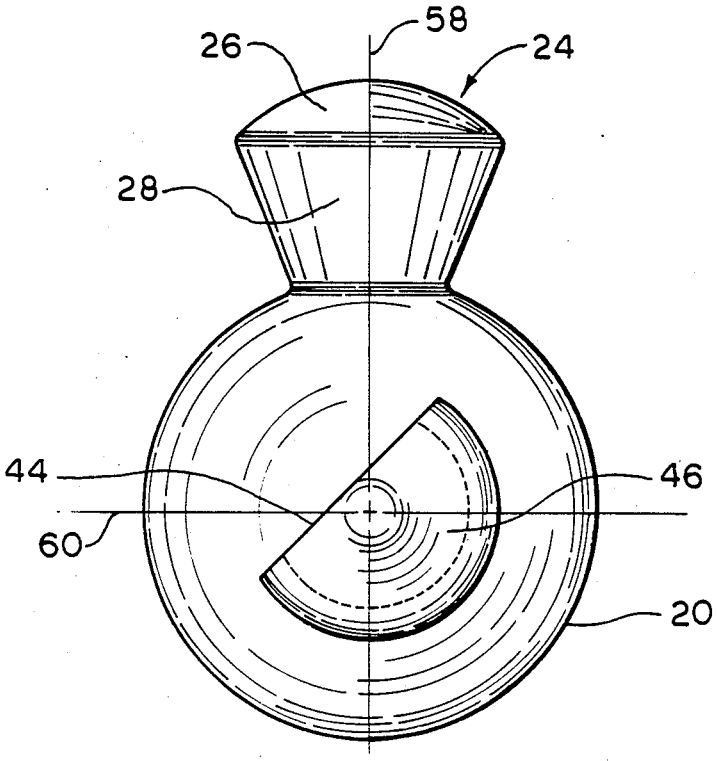
FIG. 6, represents a side view of the bowling ball insert shown in FIG. 3, taken along line 6—6.

Referring now to FIGS. 5 and 6, it can be seen that the surface 34 of the pin side member 30 is fixed at an angle A with respect to the vertical axis of the core 20. Similarly, the surface 44 of the extending wing member 40 or, as previously referred, the non-pinned side member 40 is at an angle B with respect to the vertical axis of the core 20.

The core member 20 can be manufactured from any strong non-metallic material. It has been found that any heavy material makes a good bonding agent, e.g., barium oxide.

In bowling, there are a plurality of types of ways to throw a ball; for instance, a bowler can throw a full roller, in which the track of the ball lies between the thumb hole and finger holes. Another would be a high roller which makes a track approximately $\frac{3}{4}$ of the ball diameter such as shown in FIG. 1, as line 56. It can be seen that the track 56 lies to the left of the thumb hole 14 and finger hole 12 as the ball 10 rotates in the direction of thumb hole 14. As the ball 10 rotates, it can be seen that the track 56 is approximately perpendicular to the line 50 and the reason for this is the effect of the pin side member 30 working in conjunction with the non-pin side member 40. At the time the ball 10 is released down the alley, the top extending member 24, which is heavier than extending members 30 and 40, places a little more weight to the top of the ball. This gives the ball increased rotation, or said another way, gives the ball 10 more revolutions as the ball travels down the alley which gives the ball extra impact when the ball 10 makes contact with the pins. Also, at the time the ball 10 is released, the pin side member 30, which is heavier than non-pin side 40, or the negative side of the ball, gives extra weight to the positive side of the ball, orients the ball, as it is rolling, such that it causes the track 56 to stay off of the thumb hole 14 or finger holes 10. The nonpin side member 40 tends to keep the positive side of the ball 10 in position; i.e., gives the ball 10 stability and better trajectory as it rolls down the lane.

The core member 20 can be adjusted, during manufacture, to put more or less weight at the top of the ball 10.

Figure 5A:
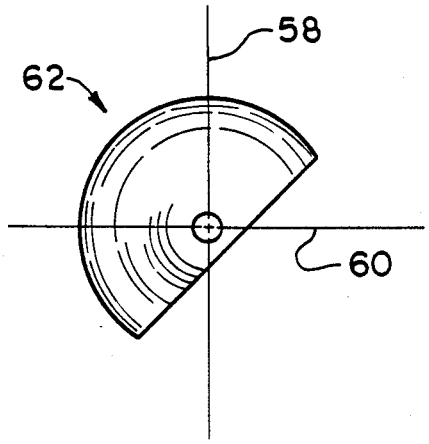
FIG. 5A represents a view showing the pin side wing in position for a left-handed ball.
Figure 6A:
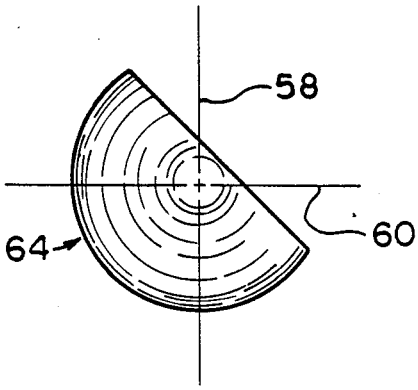
FIG. 6A represents a view showing the non-pin side wing member in position for a left-handed bowler.

This invention has been described for a right-handed bowler, therefore, for a left-handed bowler, looking at FIG. 4, the pin side member 30 and non-pin side member 40 would have to be reversed and rotated, see FIGS. 5A, and 6A. Vertical line 58 and horizontal line 60 have been added to the FIGS. 5 and 6 for purposes of orientation. It can be seen that the extending wing members 62 and 64, which are identical to extending wing members 30 and 40, need to be molded such that wing member 62 is moved 90° in a counter clockwise direction and wing member 64 is moved 90° in a clockwise direction.

Although the invention has been described as having frusto-conical shaped members integral to a sphere, it is noted that the invention could work with other shaped extending members such elliptical, cylindrical, rectangular, etc. The important thing is that the core not interfere with a smooth roll. The smooth roll adds to the efficiency of the ball upon impact with the pins. It is also noted that this invention may be embodied in other specific forms without departing from the spirit thereof. The preferred embodiment illustrated herein is therefore to be considered in all respects as being illustrative and not restrictive, the scope of the invention being indicated by the appended claims, rather than by the foregoing specification.

What is claimed is:

1. A bowling ball having a top side and positive side comprising:

a core including a main body including a plurality of weights having configurations which are irregular and different from each other, said weights generally lying in the same plane and on the outer surface of said core, and an outer spherical shell member, said shell member completely encapsulating said core member, said core member not necessarily being located at the center of said outer shell, said location determined by the weight desired at the top of the ball.

2. A bowling ball according to claim 1, wherein said plurality of weights comprise three spaced apart and outwardly extending weights, and wherein two of said outwardly extending weights are disposed, in a spaced relationship, generally opposite each other.

3. A bowling ball according to claim 1, wherein said plurality of weights comprise three angularly spaced weights are frusto-conical in configuration and wherein two of said weights are disposed on the positive side and negative side of the ball in a spaced relationship generally opposite each other.

4. A bowling ball according to claim 3, in which one of said weights is frusto-conical in configuration and where said remaining weights are partially frusto-conical in configuration, each of said remaining two weights having a flat surface, said flat surfaces being disposed at different angles with respect to each other.

5. A bowling ball comprising:

a core member including a central member and a plurality of weights integral thereto, said weights having generally unique geometric configurations generally resembling frusto-conical members, wherein at least two of said weights include a flat surface extending outwardly from said central member, said flat surfaces being angularly disposed with respect to each other, and further, one of said two weights having a mass greater than the other, said three weights lying generally in the same plane, a spherical body having an outer surface and center point encasing said core member, said core member being disposed remote from the center of said spherical body and indicia located on the outer surface of said spherical body indicating the orientation of said weights, said indicia providing the means whereby finger holes and thumb holes can be drilled on the outer surface of said spherical member.

6. A bowling ball having thumb and finger holes:

a core member including a plurality of outwardly extending wings, each outwardly extending wing having a longitudinal axis and all having the geometric configuration of a frustum, excepting that two of said wing members have a flat surface extending throughout the longitudinal axis of said wing member, said two wing members being disposed in a spaced relation to each other, and said flat surfaces being angularly disposed with each other, and one of said two weights having a mass greater than the other, and said plurality of outwardly extending wings all being generally disposed in the same plane, a solid sphere, having a center point, encapsulating said core member, one of said wing members, being disposed in close proximity to the outer surface of said solid sphere, said one wing member known as a top weight member, indicia means placed on the outside surface of said sphere, adjacent said extending wing member, said indicia thereby indicating the position of said wing member, said indicia further serving the means for the positioning of finger holes and thumb holes.

7. A bowling ball comprising:

a solid spherical shell having an outside wall surface a core including a center member and first, second, third weight members all disposed generally in the same plane and extending outwardly from said center member, said first weight member having a mass greater than that of said second and third members, said solid spherical shell completely encasing said core such that said first member is disposed in close proximity to the outside wall surface of said ball, indicia placed on the outside wall surface of said ball adjacent said first weight member a positive side of said bowling ball defined as the side located adjacent said second weight member, said second member having a mass greater than said third member, and thumb hole and finger holes placed on said bowling ball such that said first weight member is located between said finger holes and said thumb hole, such that when the bowling ball is rolled down an alley, the second weight member will cause the ball to tilt in a downward direction on the positive side such that the roll of the ball will avoid said finger holes and thumb hole, and where said first weight will cause the ball rotation to increase as the balls rolls down the alley, and where said third weight member provides stability to said ball, and provides for better penetration and less deflection upon impact.

8. A bowling ball comprising:

a solid spherical shell having an outside wall surface, a core including a spherical member and a plurality of elongated wing members extending outwardly from said spherical member, said elongated wing members including one top weight wing member having a frusto conical geometric configuration, said remaining wing members having frusto conical geometric configurations excepting that said remaining wing members each has a generally flat surface throughout the length thereof and where at least one of said remaining elongated wing members is heavier than the rest of said remaining wing members, said solid spherical shell completely encapsulating said core such that said top weight wing member is in close proximity to the outside wall surface, indicia placed on the outside wall surface immediately adjacent said top weight wing member, a positive said of said bowling ball defined as being the side located adjacent said wing member being described as the heaviest of said wing members, and thumb hole and finger holes located on said bowling ball wherein said top weight member is located depending on weight distribution desired, such that when the bowling ball is rolled down an alley, the heavy wing member will cause the cowling ball to tilt such that the ball will develop a rolling track which avoids the thumb hole and finger holes, and where said top weight wall cause the ball to roll with increased revolutions as the ball rolls down the alley and where said remaining wing members provide stability to said ball.

* * * * *